US010978775B2

(12) United States Patent
Wu et al.

(10) Patent No.: US 10,978,775 B2
(45) Date of Patent: Apr. 13, 2021

(54) CAVITY RESONATOR, FILTER, AND COMMUNICATIONS DEVICE

(71) Applicant: HUAWEI TECHNOLOGIES CO., LTD., Guangdong (CN)

(72) Inventors: Damiao Wu, Shenzhen (CN); Zheng Cui, Shenzhen (CN); Huanqing Zhang, Dongguan (CN); Yuntao Zhu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/510,414

(22) Filed: Jul. 12, 2019

(65) Prior Publication Data

US 2019/0334222 A1 Oct. 31, 2019

Related U.S. Application Data

(63) Continuation of application No. PCT/CN2017/071174, filed on Jan. 13, 2017.

(51) Int. Cl.
*H01P 7/06* (2006.01)
*H01P 1/20* (2006.01)

(52) U.S. Cl.
CPC . *H01P 7/06* (2013.01); *H01P 1/20* (2013.01)

(58) Field of Classification Search
CPC ..... H01P 7/06; H01P 1/20
USPC ..... 333/227
See application file for complete search history.

(56) References Cited

U.S. PATENT DOCUMENTS

| | | | | |
|---|---|---|---|---|
| 3,955,161 | A | 5/1976 | Macturk | |
| 10,505,244 | B2 * | 12/2019 | Koo | H01P 7/04 |
| 2014/0327499 | A1 | 11/2014 | Park et al. | |
| 2015/0288044 | A1 | 10/2015 | Schöninger | |

(Continued)

FOREIGN PATENT DOCUMENTS

| | | | |
|---|---|---|---|
| CN | 101938027 | A | 1/2011 |
| CN | 101976750 | A | 2/2011 |
| CN | 102544656 | A | 7/2012 |

(Continued)

OTHER PUBLICATIONS

Office Action issued in Chinese Application No. 201780035539.2 dated Jun. 5, 2019, 7 pages.

(Continued)

*Primary Examiner* — Robert J Pascal
*Assistant Examiner* — Kimberly E Glenn
(74) *Attorney, Agent, or Firm* — Fish & Richardson P.C.

(57) ABSTRACT

Examples of cavity resonators, filters, and communications devices are described. One example of cavity resonator includes a cover, a resonant column, and a cavity. The cover is mounted at an opening of a top portion of the cavity. The resonant column is disposed at a bottom portion of the cavity. A value of distributed capacitance is changed with a distance between the cover and the resonant column, a value of distributed inductance is changed with a distance between the cavity and the resonant column, and a material of at least one of the cover, the resonant column, and the cavity is a plastic metal material. Therefore, when the at least one of the cover, the resonant column, or the cavity deforms, the value of the distributed capacitance or the distributed inductance is changed, to adjust a resonant frequency.

20 Claims, 4 Drawing Sheets

(56) References Cited

U.S. PATENT DOCUMENTS

2016/0233567 A1 8/2016 Tong et al.

FOREIGN PATENT DOCUMENTS

| | | | |
|---|---|---|---|
| CN | 102544657 | A | 7/2012 |
| CN | 102881983 | A | 1/2013 |
| CN | 103107389 | A | 5/2013 |
| CN | 203707299 | U | 7/2014 |
| CN | 104716411 | A | 6/2015 |
| CN | 104716412 | A | 6/2015 |
| CN | 205069821 | U | 3/2016 |
| EP | 1746681 | A1 | 1/2007 |
| EP | 2323214 | A1 | 5/2011 |
| WO | 2007009532 | A1 | 1/2007 |

OTHER PUBLICATIONS

PCT International Search Report and Written Opinion issued in International Application No. PCT/CN2017/071174 dated Sep. 27, 2017, 17 pages (with English translation).
Extended European Search Report issued in European Application No. 17891734.0 dated Nov. 27, 2019, 7 pages.
Huang Hao-qiang, "The optimization design of high-power cavity filter," Journal of the Hebei Academy of Sciences, vol. 25, No. 2, Jun. 2008, 4 pages (English abstract).
Office Action issued in Chinese Application No. 201780035539.2 dated Sep. 29, 2020, 9 pages (with English translation).

* cited by examiner

- - PRIOR ART - -

CAVITY RESONATOR, FILTER, AND COMMUNICATIONS DEVICE

CROSS-REFERENCE TO RELATED APPLICATIONS

This application is a continuation of International Application No. PCT/CN2017/071174, filed on Jan. 13, 2017, the disclosure of which is hereby incorporated by reference in its entirety.

TECHNICAL FIELD

This application relates to the field of wireless communications, and in particular, to a cavity resonator, a filter, and a communications device.

BACKGROUND

A cavity filter is a common type of filter in a wireless communications device. An existing cavity filter may include at least one cavity resonator. Each cavity resonator may be as shown in FIG. 1. The cavity resonator may include a cavity 1, a resonant column 2, a screw 3, a nut 4, a cover 5, a pad 6, and a tuning threaded rod 7. An inner bottom surface of the cavity 1 is disposed with a boss. The boss is disposed with a threaded hole. The resonant column 2 may be mounted on the boss through the screw 3. The cover 5 is disposed with a threaded hole. The tuning threaded rod 7 may be fastened on the cover 5 through the nut 4 and the pad 6. The tuning threaded rod 7 is rotated in the threaded hole on the cover 5, to adjust a distance between a bottom portion of the tuning threaded rod 7 and a top portion of the resonant column 2, thereby adjusting a resonant frequency.

The cavity resonator generally works in an environment of a strong electric field. Therefore, a thread on a part that is of the tuning threaded rod and that is not in contact with the cover is generally exposed in the strong electric field directly, and generates a plurality of signals of different resonant frequencies under the action of the strong electric field. The plurality of signals of different resonant frequencies may be mutually modulated. This generates an intermodulation interference signal. To be specific, the cavity resonator has a problem of intermodulation sensitivity. The intermodulation interference signal affects a filtering capability of the cavity resonator, and results in a decrease in the filtering capability of the cavity resonator, to be specific, results in a decrease in a direct-through rate of the cavity resonator. In addition, the tuning threaded rod is in a threaded connection to the cover. The tuning threaded rod and the cover may be loose after being used for a long time. This also results in the intermodulation sensitivity in the cavity resonator.

SUMMARY

Embodiments of this application provide a cavity resonator, a filter, and a communications device, to reduce intermodulation sensitivity in a cavity resonator, and increase a direct-through rate of the cavity resonator.

According to a first aspect, a cavity resonator is provided. The cavity resonator includes a cover, a resonant column, and a cavity. The cover is mounted at an opening of a top portion of the cavity. The resonant column is disposed at a bottom portion of the cavity. Atop portion of the resonant column faces towards the cover. A material of at least one of the cover, the resonant column, and the cavity is a plastic metal material, to adjust a resonant frequency through deformation of the plastic metal material.

The cover is mounted at the opening of the top portion of the cavity, the resonant column is disposed at the bottom portion of the cavity, a value of distributed capacitance is changed with a distance between the cover and the resonant column, and a value of distributed inductance is changed with a distance between the cavity and the resonant column. Therefore, when at least one of the cover or the resonant column deforms, resulting in the change in the distance between the cover and the resonant column, the value of the distributed capacitance is changed, and when at least one of the resonant column or the cavity deforms, resulting in the change in the distance between the resonant column and the cavity, the value of the distributed inductance is changed, to adjust a resonant frequency, thereby avoiding intermodulation sensitivity resulting from poor contact between a tuning threaded rod and the cover, and increasing a direct-through rate. In addition, because a structure of the cavity resonator is simplified, space occupied by a height of a tuning screw is avoided, thereby reducing an overall height of the cavity resonator, and reducing spatial occupation of the cavity resonator.

The plastic metal material has a feature of no bounce after deformation. Therefore, the cover, the resonant column, or the cavity may deform through an operation such as impact, pressing, or pulling of an external force, and the cover, the resonant column, and the cavity do not bounce back and restore after deformation.

Optionally, the top portion of the cavity is disposed with the opening, the resonant column is mounted on an inner bottom surface of the cavity, and a material of at least one of the cover and the cavity is the plastic metal material.

The resonant column may be directly mounted on the inner bottom surface of the cavity through a screw, welding, or the like. Alternatively, a boss may be disposed in the cavity, the boss is disposed with a threaded hole, and the resonant column may be mounted on the boss through a screw.

Optionally, the top portion and the bottom portion of the cavity each are disposed with an opening, a bottom portion of the resonant column is disposed with an opening, and the opening of the bottom portion of the resonant column is extended to communicate with the opening of the bottom portion of the cavity, to form a bottom surface of the cavity.

When a vertical section of the resonant column is step-shaped or n-shaped, the opening of the bottom portion of the resonant column is extended to communicate with the opening of the bottom portion of the cavity.

In addition, when the materials of the resonant column, the cover, and the cavity are all plastic metal materials, only the resonant column may deform, to adjust the resonant frequency, or only the cover may deform, to adjust the resonant frequency, or only the cavity may deform, to adjust the resonant frequency, or any two of the resonant column, the cover, and the cavity may both deform, to adjust the resonant frequency, or the resonant column, the cover, and the cavity all deform, to adjust the resonant frequency.

Optionally, the material of the cover is the plastic metal material, and the cover is disposed with a groove.

When the cover is disposed with the groove, a thickness of a location at which the groove in the cover is located becomes smaller. Therefore, the cover relatively easily deforms.

Optionally, the cover is disposed with a protrusion.

Because the cover is disposed with the protrusion, it is convenient to pull the protrusion to enable the cover to deform, so that the cover is away from the resonant column. After the cover deforms downwards, the protrusion may also be pulled upwards to restore the deformed cover to a location before the deformation.

Optionally, when the cover is disposed with the groove, the protrusion may be disposed on the groove of the cover.

Optionally, the material of the cover is the plastic metal material, and the cover is disposed with a pull-tab.

The cover deforms by pulling the pull-tab, so that the cover is away from the resonant column, to increase the distance between the cover and the resonant column. After the cover deforms downwards, the pull-tab may also be pulled upwards to restore the deformed cover to a location before the deformation.

Optionally, the resonant column and the cavity are integrally formed or separately connected to each other.

When the resonant column is separately connected to the cavity, the resonant column may be connected to the cavity through welding, a screw, or the like.

Optionally, the resonant column is a bucket-shaped resonant column, and a vertical section of the resonant column is H-shaped, U-shaped, or step-shaped.

It should be noted that when the vertical section of the resonant column is a section perpendicular to a horizontal plane, and the vertical section may be H-shaped, U-shaped, or step-shaped. Certainly, in actual application, the vertical section of the resonant column may alternatively have another shape, for example, an n-shape. The n-shape may also be referred to as a U-shape having a downward opening.

According to a second aspect, an embodiment of this application provides a filter. The filter includes the cavity resonator according to the first aspect.

According to a third aspect, an embodiment of this application provides a communications device. The communications device includes the filter according to the second aspect.

The cover is mounted at the opening of the top portion of the cavity, the resonant column is mounted at the bottom portion of the cavity, generally, the value of the distributed capacitance is changed with the distance between the cover and the resonant column, and the value of the distributed inductance is changed with the distance between the cavity and the resonant column. Therefore, when the at least one of the cover or the resonant column deforms, resulting in the change in the distance between the cover and the resonant column, the value of the distributed capacitance is changed, and when the at least one of the resonant column or the cavity deforms, resulting in the change in the distance between the resonant column and the cavity, the value of the distributed inductance is changed, to adjust the resonant frequency, thereby avoiding the intermodulation sensitivity resulting from the poor contact between the tuning threaded rod and the cover, and increasing the direct-through rate. In addition, because the structure of the cavity resonator is simplified, the space occupied by the height of the tuning screw is avoided, thereby reducing the overall height of the cavity resonator, and reducing the spatial occupation of the cavity resonator.

REFERENCE NUMERALS

In the prior art: 1: Cavity; 2: Resonant column; 3: Screw; 4: Nut; 5: Cover; 6: Pad; and 7: Tuning threaded rod.

In the embodiments of this application: 8: Cover; 9: Resonant column; and 10: Cavity.

DESCRIPTION OF EMBODIMENTS

The following further describes implementations of this application with reference to the accompanying drawings.

Figure 1:
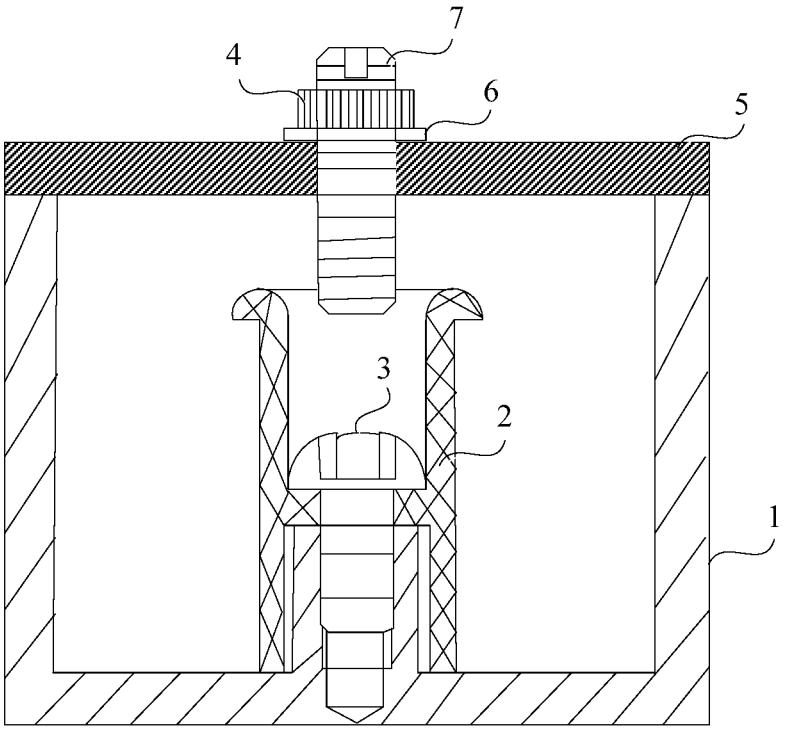
FIG. 1 is a schematic structural diagram of a cavity resonator in the prior art.
Figure 2:
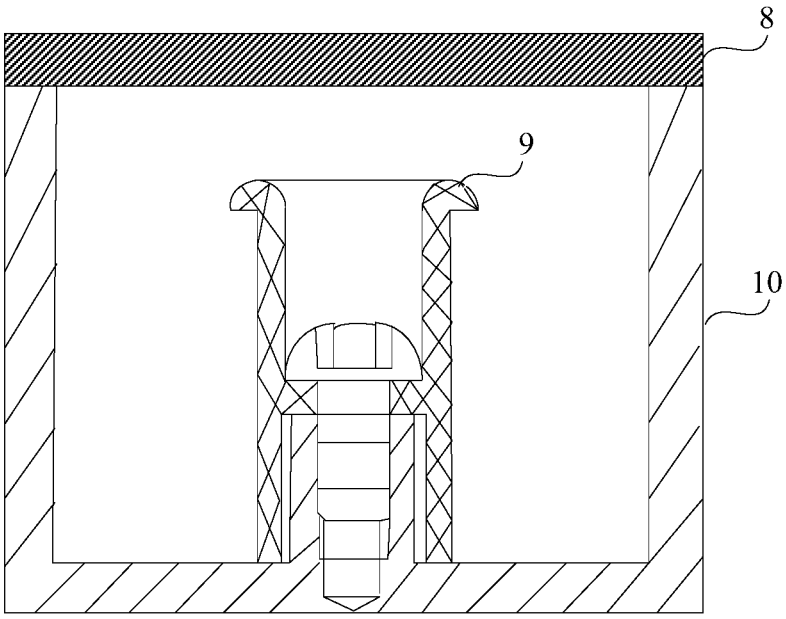
FIG. 2 is a schematic structural diagram of a first cavity resonator according to an embodiment of this application.

FIG. 2 is a schematic structural diagram of a cavity resonator according to an embodiment of this application. Referring to FIG. 2, the cavity resonator includes a cover 8, a resonant column 9, and a cavity 10.

The cover 8 is mounted at an opening of a top portion of the cavity 10. The resonant column 9 is disposed at a bottom portion of the cavity 10. A top portion of the resonant column 9 faces towards the cover 8. A material of at least one of the cover 8, the resonant column 9, and the cavity 10 is a plastic metal material, to adjust a resonant frequency through deformation of the plastic metal material.

The cover 8 is mounted at the opening of the top portion of the cavity 10, the resonant column 9 is disposed at the bottom portion of the cavity 10, a value of distributed capacitance is changed with a distance between the cover 8 and the resonant column 9, and a value of distributed inductance is changed with a distance between the cavity 10 and the resonant column 9. Therefore, when at least one of the cover 8 or the resonant column 9 deforms, resulting in the change in the distance between the cover 8 and the resonant column 9, the value of the distributed capacitance is changed, and when at least one of the resonant column 9 or the cavity 10 deforms, resulting in the change in the distance between the resonant column 9 and the cavity 10, the value of the distributed inductance is changed, to adjust the resonant frequency, thereby avoiding intermodulation sensitivity resulting from poor contact between a tuning threaded rod and the cover, and increasing a direct-through rate. In addition, because a structure of the cavity resonator is simplified, space occupied by a height of a tuning screw is avoided, thereby reducing an overall height of the cavity resonator, and reducing spatial occupation of the cavity resonator.

In this embodiment of this application, a sectional view of the cavity resonator is used as an example for description, and does not constitute a limitation on this embodiment of this application.

The plastic metal material may be a plastic metal material such as aluminum or copper, or may be another plastic metal material.

It should be noted that in this embodiment of this application, the resonant column 9 and the cavity 10 may be integrally formed or separately connected to each other. When the resonant column 9 is separately connected to the cavity 10, the resonant column 9 may be connected to the cavity 10 through welding, a screw, or the like.

In addition, the resonant column 9 is a bucket-shaped resonant column, a vertical section of the resonant column is a section perpendicular to a horizontal plane, and the vertical section may be H-shaped, U-shaped, or step-shaped. Certainly, in actual application, the vertical section of the resonant column may alternatively have another shape, for example, an n-shape. The n-shape may also be referred to as a U-shape having a downward opening.

Based on different shapes of the resonant column 9, this embodiment of this application may include at least the following four implementations.

In a first possible implementation, the vertical section of the resonant column 9 may be H-shaped. The top portion of the cavity 10 is disposed with the opening. The resonant column 9 may be mounted on an inner bottom surface of the cavity. The cover 8 may be mounted at the opening of the top portion of the cavity 10. The material of at least one of the cover 8 and the cavity 10 is the plastic metal material.

The resonant column 9 and the cavity 10 may be integrally formed or separately connected to each other. Therefore, when the resonant column 9 is separately connected to the cavity, the resonant column 9 may be directly mounted on the inner bottom surface of the cavity through a screw, welding, or the like. Alternatively, referring to FIG. 2, a boss may be disposed in the cavity 10, the boss is disposed with a threaded hole, and the resonant column 9 may be mounted on the boss through a screw.

It should be noted that in the first possible implementation, the cavity 10 may be a cylindrical cavity having a top portion disposed with an opening, or may be a rectangular cavity having a top portion disposed with an opening, or may be a cavity having an irregular shape and having a top portion disposed with an opening.

In addition, in the first possible implementation, the material of the cover 8 may be the plastic metal material, the material of the cavity 10 may be the plastic metal material, and certainly, the materials of the cover 8 and the cavity 10 may both be the plastic metal materials.

When the material of the cover 8 is the plastic metal material, the cover 8 may deform through an operation such as impact or pressing of an external force. The distance between the cover 8 and the resonant column 9 may be changed because of the deformation of the cover 8, thereby changing the value of the distributed capacitance in the cavity resonator, to adjust the resonant frequency.

Figure 3:
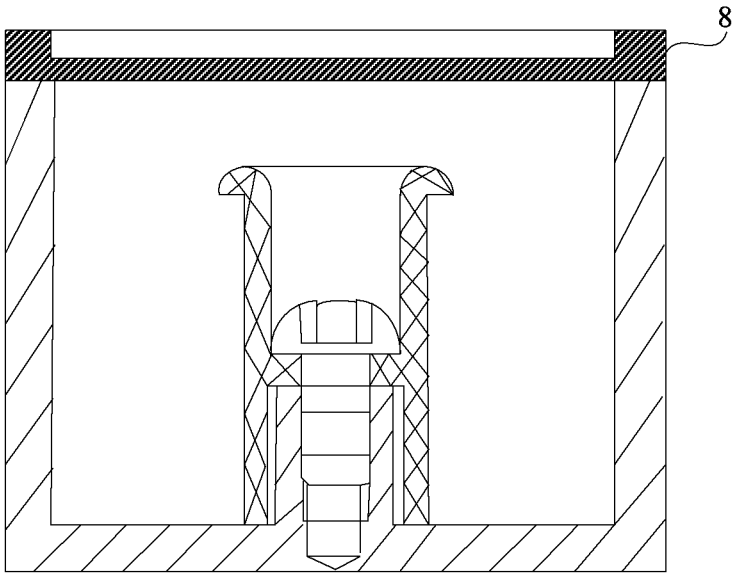
FIG. 3 is a schematic structural diagram of a second cavity resonator according to an embodiment of this application.

When the material of the cover 8 is the plastic metal material, referring to FIG. 3, the cover 8 may be disposed with a groove. When the cover 8 is disposed with the groove, a thickness of a location at which the groove in the cover 8 is located becomes smaller, so that the cover 8 relatively easily deforms.

Figure 4:
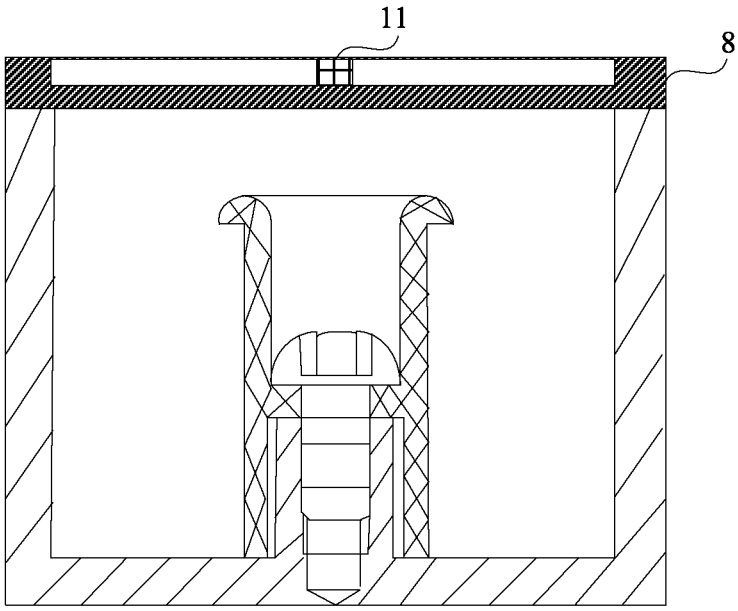
FIG. 4 is a schematic structural diagram of a third cavity resonator according to an embodiment of this application.

In addition, referring to FIG. 4, the cover 8 may be disposed with a protrusion 11. In addition, when the cover 8 is disposed with the groove, the protrusion 11 may be provided on the groove of the cover 8. For ease of description, a direction close to the bottom portion of the cavity is referred to as a lower part, and a direction away from the bottom portion of the cavity is referred to as an upper part. The cover 8 may deform by pulling the protrusion 11 upwards, so that the cover 8 is away from the resonant column 9, to increase the distance between the cover 8 and the resonant column 9. After the cover 8 deforms downwards, the protrusion 11 may also be pulled upwards to restore the downwards deformed cover 8 to a location before the deformation. Certainly, in actual application, the protrusion 11 may be disposed on the cover 8, and the protrusion 11 may be pulled upwards, so that the cover 8 is away from the resonant column 9. In addition, a pull-tab may be disposed on the cover 8, and the pull-tab is pulled upwards, so that the cover 8 is away from the resonant column 9.

Optionally, the material of the cavity 10 may also be the plastic metal material, the cavity 10 may deform through an operation such as impact or pressing of an external force. The distance between the cavity 10 and the resonant column 9 may be changed because of the deformation of the cavity 10, thereby changing the value of the distributed inductance in the cavity resonator, to adjust the resonant frequency.

In addition, when the materials of the cover 8 and the cavity 10 are both the plastic metal materials, either of the cover 8 and the cavity 10 may deform, to adjust the resonant frequency. Certainly, the cover 8 and the cavity 10 may alternatively both deform, to adjust the resonant frequency.

It should be noted that the plastic metal material has a feature of no bounce after deformation. Therefore, the cover 8 or the cavity 10 may deform under the action of an external force, and the cover 8 and the cavity 10 do not bounce back and restore after deformation.

Figure 5:
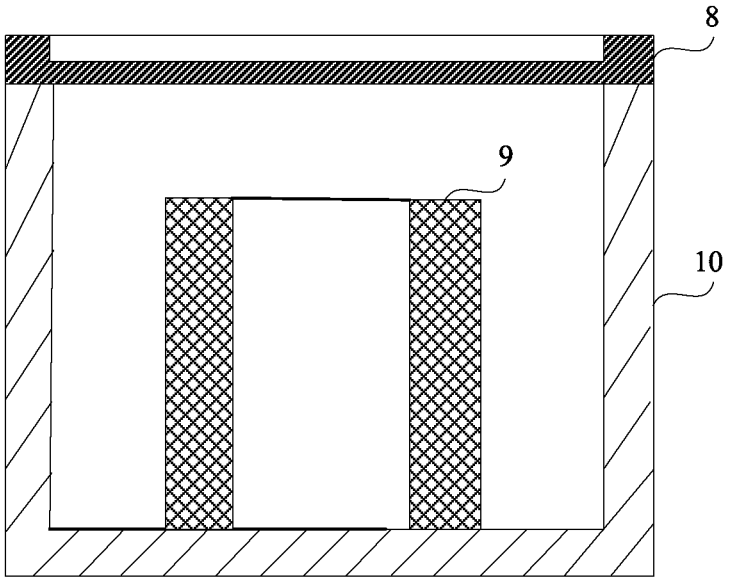
FIG. 5 is a schematic structural diagram of a fourth cavity resonator according to an embodiment of this application.

In a second possible implementation, referring to FIG. 5, the vertical section of the resonant column 9 may be U-shaped. A bottom portion of the resonant column is connected to the inner bottom surface of the cavity 10, so that the resonant column is mounted on the inner bottom surface of the cavity 10. The cover 8 is mounted at the opening of the top portion of the cavity 10. The material of at least one of the cover 8 and the cavity 10 is the plastic metal material.

It should be noted that in the second possible implementation, the cavity 10 may be a cylindrical cavity having a top portion disposed with an opening, or may be a rectangular cavity having a top portion disposed with an opening, or may be a cavity having an irregular shape and having a top portion disposed with an opening.

In addition, in the second possible implementation, the material of the cover 8 may be the plastic metal material, the material of the cavity 10 may be the plastic metal material, and certainly, the materials of the cover 8 and the cavity 10 may both be the plastic metal materials.

Figure 6:
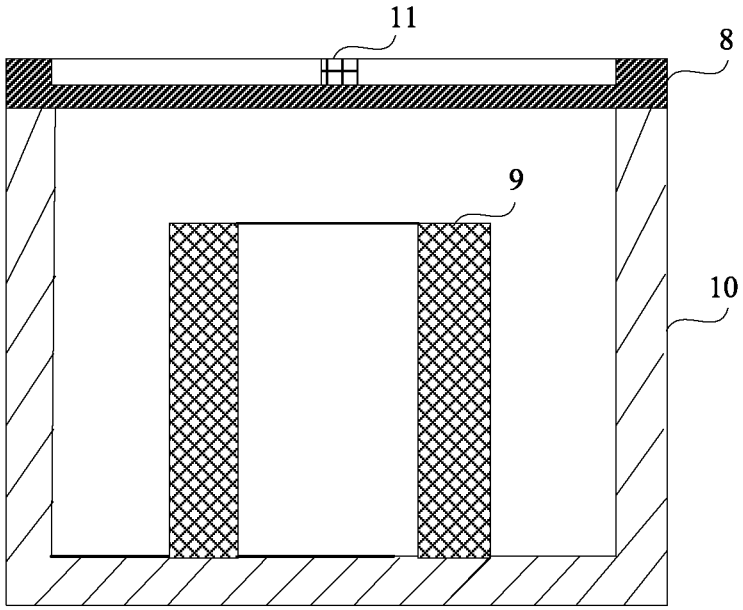
FIG. 6 is a schematic structural diagram of a fifth cavity resonator according to an embodiment of this application.

When the material of the cover 8 is the plastic metal material, referring to FIG. 5, the cover 8 may be disposed with the groove, to facilitate deformation. In addition, referring to FIG. 6, the groove may further be disposed with a protrusion 11, to conveniently perform an operation on the cover 8, for example, pulling upwards, so that the cover 8 is away from the resonant column 9.

In addition, when the material of the cavity 10 is the plastic metal material, the cavity 10 may deform under the action of an external force. The distance between the cavity 10 and the resonant column 9 may be changed because of the deformation of the cavity 10, thereby changing the value of the distributed inductance in the cavity resonator, to adjust the resonant frequency.

It should be noted that when the materials of the cover 8 and the cavity 10 are both the plastic metal materials, either of the cover 8 and the cavity 10 may deform, to adjust the resonant frequency. Certainly, the cover 8 and the cavity 10 may alternatively both deform, to adjust the resonant frequency.

Figure 7:
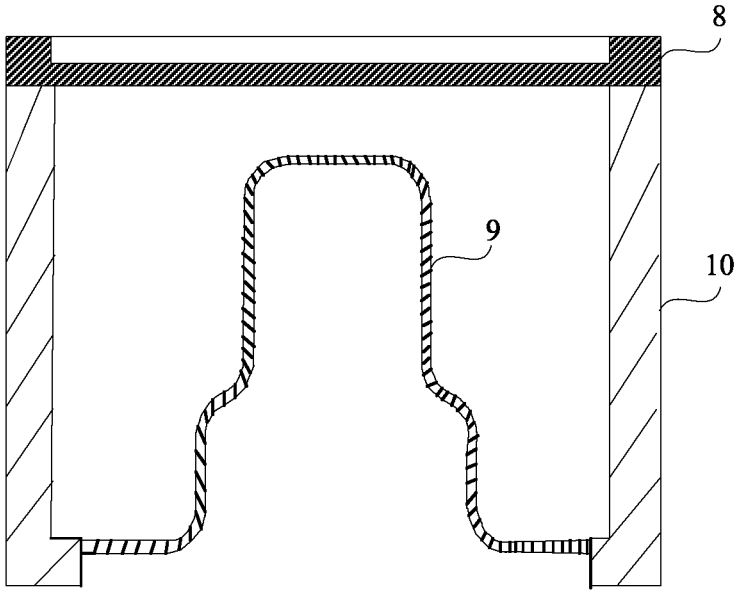
FIG. 7 is a schematic structural diagram of a sixth cavity resonator according to an embodiment of this application.

In a third possible implementation, referring to FIG. 7, the vertical section of the resonant column 9 may be step-shaped. The top portion and the bottom portion of the cavity 10 each are disposed with an opening. The bottom portion of the resonant column 9 is disposed with an opening, and the opening of the bottom portion of the resonant column 9 is extended to communicate with the opening of the bottom portion of the cavity 10, to form a bottom surface of the cavity.

In the third possible implementation, the cavity 10 may be a cylindrical cavity having a top portion and a bottom portion each disposed with an opening, or may be a rectangular cavity having a top portion and a bottom portion each disposed with an opening, or may be a cavity having an irregular shape and having a top portion and a bottom portion each disposed with an opening.

It should be noted that in the third possible implementation, the material of the resonant column 9 may be the plastic metal material, and when the material of the resonant column 9 is the plastic metal material, the resonant column 9 may deform through an operation such as impact or pressing of an external force. When the resonant column 9 deforms near the cover 8, to be specific, the resonant column 9 deforms in an axial direction, the distance between the resonant column 9 and the cover 8 is reduced, thereby changing the value of the distributed capacitance in the cavity resonator, to adjust the resonant frequency. When the resonant column 9 deforms near the cavity 10, to be specific, the resonant column 9 deforms horizontally, the distance between the resonant column 9 and the cavity 10 is increased, thereby changing the value of the distributed inductance in the cavity resonator, to adjust the resonant frequency.

It should be noted that the plastic metal material has a feature of no bounce after deformation. Therefore, the resonant column 9 does not bounce back and restore after deformation.

Optionally, the material of the cover 8 may be the plastic metal material, or the material of the cavity 10 may be the plastic metal material. Certainly, the materials of any two of the cover 8, the resonant column 9, and the cavity 10 may be the plastic metal materials, or the materials of the cover 8, the resonant column 9, and the cavity 10 may all be the plastic metal materials.

In addition, when the material of the cover 8 is the plastic metal material, the cover 8 may deform, to adjust the resonant frequency. The cover 8 may further be disposed with a groove, so that the cover easily deforms. In addition, the groove may be disposed with a protrusion 11, to conveniently perform an operation on the cover 8, for example, pulling upwards, so that the cover 8 is away from the resonant column 9.

In addition, when the material of the cavity 10 is the plastic metal material, the cavity 10 may deform under the action of an external force. The distance between the cavity 10 and the resonant column 9 may be changed because of the deformation of the cavity 10, thereby changing the value of the distributed inductance in the cavity resonator, to adjust the resonant frequency.

It should be noted that in this embodiment of this application, when the materials of the resonant column 9, the cover 8, and the cavity 10 are all the plastic metal materials, only the resonant column 9 may deform, to adjust the resonant frequency, or only the cover 8 may deform, to adjust the resonant frequency, or only the cavity 10 deforms, to adjust the resonant frequency, or any two of the resonant column 9, the cover 8, and the cavity 10 may both deform, to adjust the resonant frequency, or the resonant column 9, the cover 8, and the cavity 10 all deform, to adjust the resonant frequency.

Figure 8:
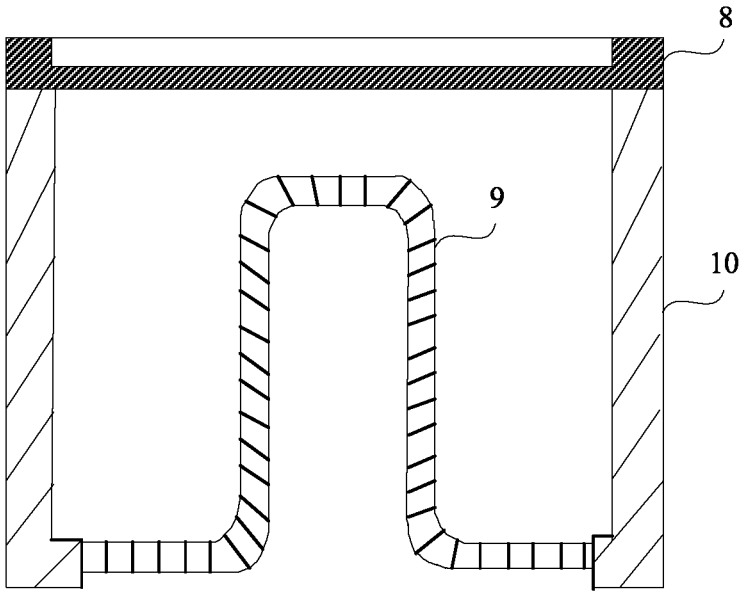
FIG. 8 is a schematic structural diagram of a seventh cavity resonator according to an embodiment of this application.

In a fourth possible implementation, referring to FIG. 8, the vertical section of the resonant column 9 may be n-shaped. A bottom portion of the resonant column 9 is disposed with an opening, and the opening of the bottom portion of the resonant column 9 is extended to communicate with an opening of the bottom portion of the cavity 10, to form a bottom surface of the cavity.

In the fourth possible implementation, the cavity 10 may be a cylindrical cavity having a top portion and a bottom portion each disposed with an opening, or may be a rectangular cavity having a top portion and a bottom portion each disposed with an opening, or may be a cavity having an irregular shape and having a top portion and a bottom portion each disposed with an opening.

It should be noted that in the fourth possible implementation, the material of the resonant column 9 may be the plastic metal material.

Optionally, the material of the cover 8 may be the plastic metal material, the material of the resonant column 9 may be the plastic metal material, and the material of the cavity 10 may also be the plastic metal material. Certainly, the materials of any two of the cover 8, the resonant column 9, and the cavity 10 may be the plastic metal materials, alternatively, the materials of the cover 8, the resonant column 9, and the cavity 10 may all be the plastic metal materials.

When the material of the cover 8 is the plastic metal material, the cover 8 may deform. In addition, the cover 8 may be disposed with a groove, to facilitate deformation of the cover 8. In addition, the groove may be disposed with a protrusion 11, to conveniently perform an operation on the cover 8, for example, pulling upwards, so that the cover 8 is away from the resonant column 9.

When the resonant column 9 is n-shaped, an operation of adjusting the resonant frequency through the cavity resonator is the same as an operation of adjusting the resonant frequency through the cavity resonator when the vertical section of the resonant column is step-shaped. Details are not described in this embodiment of this application again.

Optionally, the cover 8 and the resonant column 9 may have different forms and may further be combined in another form. For example, the resonant column in FIG. 7 or FIG. 8 may further be combined with the cover in FIG. 2 to FIG. 4 for use, or may be combined with a cover in another form in the prior art for use. The cover in FIG. 2 to FIG. 8 may alternatively be combined with a resonant column in another form in the prior art for use. This is not limited in this application.

In this embodiment of this application, the cover is mounted at the opening of the top portion of the cavity, the resonant column is mounted at the bottom portion of the cavity, the value of the distributed capacitance is changed with the distance between the cover and the resonant column, and the value of the distributed inductance is changed with the distance between the cavity and the resonant column. Therefore, when the at least one of the cover or the resonant column deforms, resulting in the change in the distance between the cover and the resonant column, the value of the distributed capacitance is changed, and when the at least one of the resonant column or the cavity deforms, resulting in the change in the distance between the resonant column and the cavity, the value of the distributed inductance is changed, to adjust the resonant frequency, thereby avoiding the intermodulation sensitivity resulting from the poor contact between the tuning threaded rod and the cover, and increasing the direct-through rate. In addition, because the structure of the cavity resonator is simplified, the space occupied by the height of the tuning screw is avoided, thereby reducing the overall height of the cavity resonator, and reducing the spatial occupation of the cavity resonator.

An embodiment of this application provides a filter. The filter includes the cavity resonator in the foregoing embodiment.

Optionally, the filter may include at least one of the foregoing cavity resonators. Optionally, the filter may include another type of resonator cascaded with the foregoing cavity resonator. Optionally, the filter may further include another element. For example, the filter may further include a capacitor, a resistor, or an inductor.

In this embodiment of this application, the cavity resonator can avoid intermodulation sensitivity, and increase a direct-through rate. Therefore, when the filter includes the cavity resonator, filtering efficiency of the filter can be improved.

An embodiment of this application provides a communications device. The communications device includes the filter in the foregoing embodiment.

The communications device may be a duplexer, a wireless transceiver device, a base station, or the like.

In this embodiment of this application, when filtering is performed through the filter, intermodulation sensitivity can be avoided, and a direct-through rate is increased. Therefore, when the communications device includes the filter, interference of an interference signal to a communications signal can be avoided, and transmission quality and efficiency of the communications signal are improved.

The foregoing descriptions are merely example embodiments of this application, but are not intended to limit this application. Any modification, equivalent replacement, or improvement made without departing from the spirit and principle of this application should fall within the protection scope of this application.

What is claimed is:

1. A cavity resonator, wherein the cavity resonator comprises a cover, a resonant column, and a cavity;

wherein the cover is mounted at an opening of a top portion of the cavity, the resonant column is disposed at a bottom portion of the cavity, and a top portion of the resonant column faces towards the cover, and wherein the cover is disposed with a groove; and wherein a material of at least one of the cover, the resonant column, or the cavity is a plastic metal material, to adjust a resonant frequency through deformation of the plastic metal material.

2. The cavity resonator according to claim 1, wherein the top portion of the cavity is disposed with the opening, wherein the resonant column is mounted on an inner bottom surface of the cavity, and wherein the material of at least one of the cover or the cavity is the plastic metal material.

3. The cavity resonator according to claim 1, wherein the top portion and the bottom portion of the cavity each are disposed with an opening, a bottom portion of the resonant column is disposed with an opening, and the opening of the bottom portion of the resonant column is extended to communicate with the opening of the bottom portion of the cavity, to form a bottom surface of the cavity.

4. The cavity resonator according to claim 1, wherein the material of the cover is the plastic metal material.

5. The cavity resonator according to claim 1, wherein the cover is disposed with a protrusion.

6. The cavity resonator according to claim 1, wherein the material of the cover is the plastic metal material, and wherein the cover is disposed with a pull-tab.

7. The cavity resonator according to claim 1, wherein the resonant column and the cavity are integrally formed or separately connected to each other.

8. The cavity resonator according to claim 1, wherein the resonant column is a bucket-shaped resonant column, and wherein a vertical section of the resonant column is H-shaped, U-shaped, or step-shaped.

9. A filter, the filter comprising a cavity resonator, wherein the cavity resonator comprises a cover, a resonant column, and a cavity;

wherein the cover is mounted at an opening of a top portion of the cavity, the resonant column is disposed at a bottom portion of the cavity, and a top portion of the resonant column faces towards the cover, and wherein the cover is disposed with a groove; and wherein a material of at least one of the cover, the resonant column, or the cavity is a plastic metal material, to adjust a resonant frequency through deformation of the plastic metal material.

10. The filter of claim 9, wherein the top portion of the cavity is disposed with the opening, wherein the resonant column is mounted on an inner bottom surface of the cavity, and wherein the material of at least one of the cover or the cavity is the plastic metal material.

11. The filter of claim 9, wherein the top portion and the bottom portion of the cavity each are disposed with an opening, wherein a bottom portion of the resonant column is disposed with an opening, and wherein the opening of the bottom portion of the resonant column is extended to communicate with the opening of the bottom portion of the cavity, to form a bottom surface of the cavity.

12. The filter of claim 9, wherein the material of the cover is the plastic metal material.

13. The filter of claim 9, wherein the cover is disposed with a protrusion.

14. The filter of claim 9, wherein the material of the cover is the plastic metal material, and wherein the cover is disposed with a pull-tab.

15. The filter of claim 9, wherein the resonant column and the cavity are integrally formed or separately connected to each other.

16. The filter of claim 9, wherein the resonant column is a bucket-shaped resonant column, and wherein a vertical section of the resonant column is H-shaped, U-shaped, or step-shaped.

17. A communications device, the communications device comprising a filter, wherein the filter comprises a cavity resonator, and wherein the cavity resonator comprises a cover, a resonant column, and a cavity;

wherein the cover is mounted at an opening of a top portion of the cavity, the resonant column is disposed at a bottom portion of the cavity, and a top portion of the resonant column faces towards the cover, and wherein the cover is disposed with a groove; and wherein a material of at least one of the cover, the resonant column, or the cavity is a plastic metal material, to adjust a resonant frequency through deformation of the plastic metal material.

18. The communications device of claim 17, wherein the top portion of the cavity is disposed with the opening, wherein the resonant column is mounted on an inner bottom surface of the cavity, and wherein the material of at least one of the cover or the cavity is the plastic metal material.

19. The communications device of claim 17, wherein the top portion and the bottom portion of the cavity each are disposed with an opening, wherein a bottom portion of the resonant column is disposed with an opening, and wherein the opening of the bottom portion of the resonant column is extended to communicate with the opening of the bottom portion of the cavity, to form a bottom surface of the cavity.

20. The communications device of claim 17, wherein the material of the cover is the plastic metal material.

* * * * *